US011575186B2

(12) United States Patent
Lv et al.

(10) Patent No.: US 11,575,186 B2
(45) Date of Patent: Feb. 7, 2023

(54) OMT ASSEMBLY AND OMT APPARATUS

(71) Applicant: Huawei Technologies Co., Ltd., Shenzhen (CN)

(72) Inventors: Tinghai Lv, Chengdu (CN); Zefeng Chen, Chengdu (CN); Jicheng Zhang, Chengdu (CN); Yong Chen, Chengdu (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 208 days.

(21) Appl. No.: 17/034,682

(22) Filed: Sep. 28, 2020

(65) Prior Publication Data

US 2021/0013568 A1 Jan. 14, 2021

Related U.S. Application Data

(63) Continuation of application No. PCT/CN2018/081810, filed on Apr. 4, 2018.

(51) Int. Cl.
*H01Q 1/24* (2006.01)
*H01P 1/161* (2006.01)
(Continued)

(52) U.S. Cl.
CPC ..... *H01P 1/161* (2013.01); *H01Q 1/24* (2013.01); *H01Q 13/0258* (2013.01); *H01Q 25/001* (2013.01)

(58) Field of Classification Search
CPC ..... H04L 5/1438; H04L 9/40; H04L 69/24; H04M 11/06; H01Q 1/24; H01Q 13/0258; H01Q 25/001; H01P 1/161
(Continued)

(56) References Cited

U.S. PATENT DOCUMENTS 4,473,828 A * 9/1984 Morz ..... H04B 7/10 455/81
4,797,681 A * 1/1989 Kaplan ..... H01Q 13/0258 333/137
(Continued)

FOREIGN PATENT DOCUMENTS

CN 101233393 A 7/2008
CN 101689691 A 3/2010
(Continued)

OTHER PUBLICATIONS

Chang-Fei, Y., et al., "Development of a W Band Orthomode Transducer", Journal of Microwaves, vol. 28 No. 5, Oct. 2012, 7 Pages.

*Primary Examiner* — Hai V Tran
(74) *Attorney, Agent, or Firm* — Slater Matsil, LLP

(57) ABSTRACT

An orth-mode transducer (OMT) assembly, including an OMT common port, an OMT feeder, and a polarization separated core. An input end of the OMT common port is connected to a single polarization antenna, one end of the OMT feeder is connected to an output end of the OMT common port, and an other end of the OMT feeder is connected to the polarization separated core, the OMT feeder has a tubular structure, and horizontal and vertical axes of an inner wall cross section of the OMT feeder are unequal, or a tuning rod is disposed in a tube of the OMT feeder and is perpendicular to an extension direction of the tube, and a vertical polarization port and a horizontal polarization port are disposed in the polarization separated core, the vertical polarization port transmits a vertical polarization wave, and the horizontal polarization port transmits a horizontal polarization wave.

21 Claims, 5 Drawing Sheets

(51) Int. Cl.
*H01Q 25/00* (2006.01)
*H01Q 13/02* (2006.01)

(58) Field of Classification Search
USPC ..... 343/904
See application file for complete search history.

(56) References Cited

U.S. PATENT DOCUMENTS 4,996,535 A * 2/1991 Profera, Jr. ..... H01Q 13/0258 343/786
2009/0284327 A1* 11/2009 Mahon ..... H01P 1/161 333/157
2010/0123615 A1 5/2010 Fehrenbach et al.
2011/0037534 A1* 2/2011 Espino ..... H01P 1/161 333/127
2011/0057849 A1 3/2011 Naym et al.
2013/0342390 A1* 12/2013 Cha ..... H01Q 19/195 342/352
2015/0097747 A1* 4/2015 Hwang ..... H01Q 13/0258 343/785
2017/0207541 A1 7/2017 Wu et al.

FOREIGN PATENT DOCUMENTS

| | | | |
|---|---|---|---|
| CN | 101794923 | A | 8/2010 |
| CN | 102136634 | A | 7/2011 |
| CN | 102195141 | A | 9/2011 |
| CN | 203674349 | U | 6/2014 |
| CN | 203871471 | U | 10/2014 |
| CN | 205104615 | U | 3/2016 |
| CN | 106129597 | A | 11/2016 |
| EP | 1158597 | A1 | 11/2001 |
| JP | H04150501 | A | 5/1992 |
| KR | 20170057688 | A | 5/2017 |
| WO | 2015185150 | A1 | 12/2015 |

* cited by examiner

OMT ASSEMBLY AND OMT APPARATUS

CROSS-REFERENCE TO RELATED APPLICATIONS

This application is a continuation of International Patent Application No. PCT/CN2018/081810, filed on Apr. 4, 2018, the disclosure of which is hereby incorporated by reference in its entirety.

TECHNICAL FIELD

This application relates to the field of antenna technologies, and in particular, to an orth-mode transducer (OMT) assembly and an OMT apparatus.

BACKGROUND

As microwave communication develops, spectrum resources are increasingly scarce. Operators need to pay high spectrum leasing fees to use spectrum resources. Therefore, single polarization transmission is upgraded to dual polarization transmission to improve spectrum utilization, and to double a transmission capacity when spectrum fees are slightly increased or not increased. This becomes the first choice for the operators to upgrade and expand microwave services being used on a live network, as mobile communication services develop.

Cross polarization discrimination (XPD) is a unique and important indicator of the dual-polarized transmission. However, the indicator is not commissioned during production of a single polarization antenna. Consequently, after the single polarization antenna used on the live network is upgraded to a dual polarization antenna, an XPD indicator of the dual polarization antenna cannot meet a requirement.

To resolve this problem, a schematic diagram of possible components of a single polarization antenna is provided. As shown in FIG. 1, the single polarization antenna includes components such as a radome, a reflective surface, a central plate and a mounting bracket, a connection plate, an antenna feeder, and a torque transition section. In the prior art, the antenna feeder can be removed onsite to adjust the XPD. In this way, XPD performance of the dual polarization antenna can meet a specification requirement after the single polarization antenna is reconstructed to the dual polarization antenna.

However, in the prior art, there is a possibility that the antenna feeder of the single polarization antenna cannot be removed or replaced. To be specific, the XPD performance of the reconstructed dual polarization antenna cannot be adjusted, and consequently, the XPD performance of the reconstructed dual polarization antenna cannot meet the specification requirement, reducing feasibility of upgrading and reconstructing the single polarization antenna to the dual polarization antenna through onsite operations.

SUMMARY

Embodiments of this application provide an OMT assembly and an OMT apparatus, to improve operability of reconstructing a single polarization antenna to a dual polarization antenna.

A first aspect of the embodiments of this application provides an orth-mode transducer (OMT) assembly. The OMT assembly includes: an OMT common port, an OMT feeder, and a polarization separated core, where an input end of the OMT common port is connected to a single polarization antenna, one end of the OMT feeder is connected to an output end of the OMT common port, and the other end of the OMT feeder is connected to the polarization separated core, so that the OMT feeder located between the OMT common port and the polarization separated core rotates, the OMT feeder is of a tubular structure, and a horizontal axis and a vertical axis of an inner wall cross section of the OMT feeder are unequal, or a tuning rod is disposed in a tube of the OMT feeder, and the tuning rod is perpendicular to an extension direction of the tube of the OMT feeder, and a vertical polarization port and a horizontal polarization port are disposed in the polarization separated core, the vertical polarization port is configured to transmit a vertical polarization wave, and the horizontal polarization port is configured to transmit a horizontal polarization wave. In the embodiments of this application, XPD performance of a to-be-reconstructed single polarization antenna is adjusted through the OMT assembly, so that the XPD performance of the to-be-reconstructed antenna can be adjusted when a feeder of the to-be-reconstructed antenna cannot be rotated, thereby greatly improving operability of upgrading and reconstructing the single polarization antenna to the dual polarization antenna.

In a possible design, in a first implementation of the first aspect of the embodiments of this application, when the horizontal axis and the vertical axis of the inner wall cross section of the OMT feeder are unequal, the inner wall cross section of the OMT feeder is an ellipse. In this implementation, it is refined that the inner wall cross section of the OMT feeder may be the ellipse. Because the horizontal axis and the vertical axis of the ellipse are unequal, a relative phase between two circular polarization signals may be adjusted, to adjust XPD performance of the dual polarization antenna.

In a possible design, in a second implementation of the first aspect of the embodiments of this application, an outer wall cross section of the OMT feeder is a circle.

In a possible design, in a third implementation of the first aspect of the embodiments of this application, an ellipticity of the ellipse is negatively correlated with a cross polarization discrimination XPD value of the single polarization antenna. In this implementation, a relationship between the ellipticity of the ellipse and the XPD value of the single polarization antenna is described, so that the embodiments of this application are more operable.

In a possible design, in a fourth implementation of the first aspect of the embodiments of this application, when the horizontal axis and the vertical axis of the inner wall cross section of the OMT feeder are unequal, the inner wall cross section of the OMT feeder is a rectangle. In this implementation, the inner wall cross section of the OMT feeder not only may be set to the ellipse, but also may be set to the rectangle to adjust the relative phase between the circular polarization signals. This provides a plurality of possible implementations.

In a possible design, in a fifth implementation of the first aspect of the embodiments of this application, when the horizontal axis and the vertical axis of the inner wall cross section of the OMT feeder are unequal, in the horizontal axis and the vertical axis, a length ratio of a shorter axis to a longer axis ranges from 0.85 to 0.99. In this embodiment of this application, the range of the length ratio of the horizontal axis to the vertical axis is provided, so that the embodiments of this application are more implementable.

In a possible design, in a sixth implementation of the first aspect of the embodiments of this application, when the tuning rod is disposed in the tube of the OMT feeder, a direction in which the tuning rod points intersects a center line of the tube of the OMT feeder. In this implementation, it is refined that the direction in which the tuning rod points intersects the center line of the tube of the OMT feeder, so that the embodiments of this application are more operable.

In a possible design, in a seventh implementation of the first aspect of the embodiments of this application, when the tuning rod is disposed in the tube of the OMT feeder, the inner wall cross section of the OMT feeder is a regular polygon. In this implementation, when the tuning rod may also be disposed in the tube of the OMT feeder, and the inner wall cross section of the OMT feeder may be the regular polygon, a manner of adjusting the XPD performance of the dual polarization antenna is added.

In a possible design, in an eighth implementation of the first aspect of the embodiments of this application, when a quantity of tuning rods disposed on the inner wall cross section on which the tuning rod is disposed in the tube of the OMT feeder is 1, a length of the tuning rod accounts for 15% to 35% of the horizontal axis or the vertical axis of the inner wall cross section of the OMT feeder. In this implementation, one tuning rod may be disposed on one inner wall cross section, so that the XPD performance of the dual polarization antenna can be adjusted through the tuning rod.

In a possible design, in a ninth implementation of the first aspect of the embodiments of this application, when a quantity of tuning rods disposed on the inner wall cross section on which the tuning rod is disposed in the tube of the OMT feeder is 2, a length of each tuning rod accounts for 7% to 18% of the horizontal axis or the vertical axis of the inner wall cross section of the OMT feeder. In this implementation, two tuning rods may be disposed on one inner wall cross section, thereby adding an implementation of the embodiments of this application.

In a possible design, in a tenth implementation of the first aspect of the embodiments of this application, that one end of the OMT feeder is connected to an output end of the OMT common port, and the other end of the OMT feeder is connected to the polarization separated core includes: one end of the OMT feeder is nestedly connected to the output end of the OMT common port, and the other end of the OMT feeder is nestedly connected to the polarization separated core. In this implementation, the OMT feeder, the OMT common port, and the polarization separated core may be nestedly connected, so that the OMT feeder can be rotated.

In a possible design, in an eleventh implementation of the first aspect of the embodiments of this application, the OMT assembly further includes a rotation component, and the rotation component is connected to an outer wall of the OMT feeder. In this implementation, the rotation component may be used to implement a rotation operation on the OMT feeder, to facilitate an onsite operation of an implementation engineer.

In a possible design, in a twelfth implementation of the first aspect of the embodiments of this application, the rotation component includes an outer hexagon nut. In this implementation, the rotation component may be the outer hexagon nut, thereby improving implementability of the embodiments of this application.

In a possible design, in a thirteenth implementation of the first aspect of the embodiments of this application, the OMT assembly further includes a lock-up component, a through hole is provided on a side wall of the output end of the OMT common port, and the lock-up component passes through the through hole and presses against the OMT feeder in the output end of the OMT common port, and the lock-up component is configured to keep the OMT feeder still after performing rotation adjustment on the OMT feeder. In this implementation, the lock-up component is further designed on the OMT common port, so that after rotation of the OMT feeder is completed, the OMT feeder keeps still, to prevent deterioration of XPD performance after the adjustment.

In a possible design, in a fourteenth implementation of the first aspect of the embodiments of this application, the lock-up component includes a screw. In this implementation, the lock-up component is specifically the screw, thereby improving implementability of the embodiments of this application.

In a possible design, in a fifteenth implementation of the first aspect of the embodiments of this application, the OMT assembly further includes a first sealing ring, the first sealing ring is placed in a first sealing groove, the first sealing groove is disposed on a surface of one end that is of the OMT feeder and that is connected to the OMT common port, and the first sealing ring is configured to seal a gap between the OMT feeder and the OMT common port. In this implementation, the OMT assembly further includes the first sealing ring, and the first sealing ring is placed in the first sealing groove disposed at one end of the OMT feeder, to implement waterproofing and adapt to a structural dimension tolerance in a radial direction.

In a possible design, in a sixteenth implementation of the first aspect of the embodiments of this application, the OMT assembly further includes a second sealing ring, the second sealing ring is placed in a second sealing groove, the second sealing groove is disposed on a surface of one end that is of the OMT feeder and that is connected to the polarization separated core, and the second sealing ring is configured to seal a gap between the OMT feeder and the polarization separated core. In this implementation, the OMT assembly further includes the second sealing ring, and the second sealing ring is placed in the second sealing groove disposed at one end of the OMT feeder, to implement waterproofing and adapt to a structural dimension tolerance in a radial direction.

In a possible design, in a seventeenth implementation of the first aspect of the embodiments of this application, a material of the OMT feeder includes a metal material. In this implementation, the material of the OMT feeder may be the metal material, thereby improving durability of the OMT feeder.

A second aspect of the embodiments of this application provides an OMT apparatus, including a framework, where the OMT apparatus further includes the OMT assembly according to any one of the first aspect or the first possible implementation to the seventeenth possible implementation of the first aspect, and the framework is configured to install and fasten the OMT assembly. In the embodiments of this application, the OMT apparatus includes the OMT assembly described in the first aspect, so that XPD performance of a to-be-reconstructed single polarization antenna is adjusted through an additionally interconnected OMT apparatus, to adjust the XPD performance of the to-be-reconstructed antenna when a feeder of the to-be-reconstructed antenna cannot be rotated. This greatly improves the operability of upgrading a single polarization antenna to a dual polarization antenna.

A third aspect of the embodiments of this application provides a dual polarization antenna, where the dual polarization antenna includes a single polarization antenna and the OMT apparatus in the second aspect, and an output end of the single polarization antenna is connected to an input end of the OMT apparatus.

It can be learned from the foregoing technical solutions that the OMT assembly provided in the embodiments of this application includes the following feature. The feature includes: the OMT common port, the OMT feeder, and the polarization separated core, where the input end of the OMT common port is connected to the single polarization antenna, one end of the OMT feeder is connected to the output end of the OMT common port, and the other end of the OMT feeder is connected to the polarization separated core, so that the OMT feeder located between the OMT common port and the polarization separated core rotates, the OMT feeder is of the tubular structure, and the horizontal axis and the vertical axis of the inner wall cross section of the OMT feeder are unequal, or the tuning rod is disposed in the tube of the OMT feeder, and the tuning rod is perpendicular to the extension direction of the tube of the OMT feeder, and the vertical polarization port and the horizontal polarization port are disposed in the polarization separated core, the vertical polarization port is configured to transmit the vertical polarization wave, and the horizontal polarization port is configured to transmit the horizontal polarization wave. In the embodiments of this application, the OMT assembly includes the rotatable OMT feeder, so that the XPD performance of the to-be-reconstructed antenna is adjusted through an additionally interconnected OMT apparatus, to adjust the XPD performance of the to-be-reconstructed antenna when the feeder of the to-be-reconstructed antenna cannot be rotated. This greatly improves the operability of upgrading the single polarization antenna to the dual polarization antenna.

DETAILED DESCRIPTION OF ILLUSTRATIVE EMBODIMENTS

Embodiments of this application provide an OMT assembly and an OMT apparatus, to improve operability of reconstructing a single polarization antenna to a dual polarization antenna.

In the specification, claims, and accompanying drawings of this application, the terms "first", "second", "third", "fourth", and the like (if existent) are intended to distinguish between similar objects but do not necessarily indicate a specific order or sequence. It needs to be understood that the data used in such a way are interchangeable in appropriate circumstances, so that the embodiments described herein can be implemented in other orders than the content illustrated or described herein. Moreover, the terms "include", "have" and any other variants mean to cover the non-exclusive inclusion, for example, a process, method, system, product, or device that includes a list of steps or units is not necessarily limited to those steps or units, but may include other steps or units not expressly listed or inherent to such a process, method, system, product, or device.

Figure 2A:
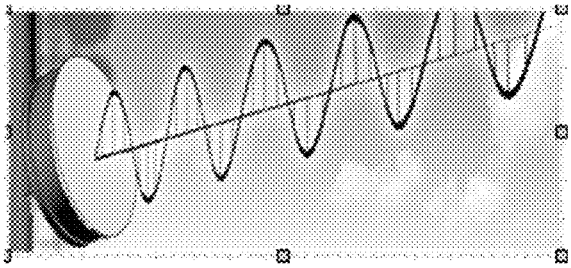
FIG. 2*a* is a schematic diagram of possible signal propagation of a single polarization antenna.
Figure 2B:
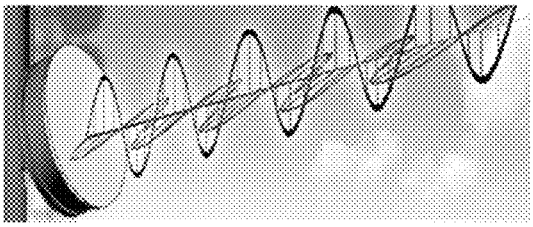
FIG. 2*b* is a schematic diagram of possible signal propagation of a dual polarization antenna.

A microwave antenna is an extremely important component in a microwave communications system, and a main function of the microwave antenna is to radiate an electromagnetic signal to space and receive an electromagnetic wave from space. The microwave antenna may include a single polarization antenna and a dual polarization antenna. FIG. 2*a* is a schematic diagram of possible signal propagation of a single polarization antenna. The single polarization antenna radiates a single polarization signal to space and receives a single polarization signal from space. FIG. 2*b* is a schematic diagram of possible signal propagation of a dual polarization antenna. The dual polarization antenna may radiate a dual polarization signal to space and receive a dual polarization signal from space, to implement frequency reuse of intra-frequency orthogonal polarization. To be specific, two signals are simultaneously transmitted at a same frequency, and a capacity of the dual polarization antenna is doubled compared with that of the single polarization antenna. It needs to be noted that the single polarization antenna in this application may be a single polarization parabolic antenna, and the dual polarization antenna may be a dual polarization parabolic antenna.

Figure 2C:
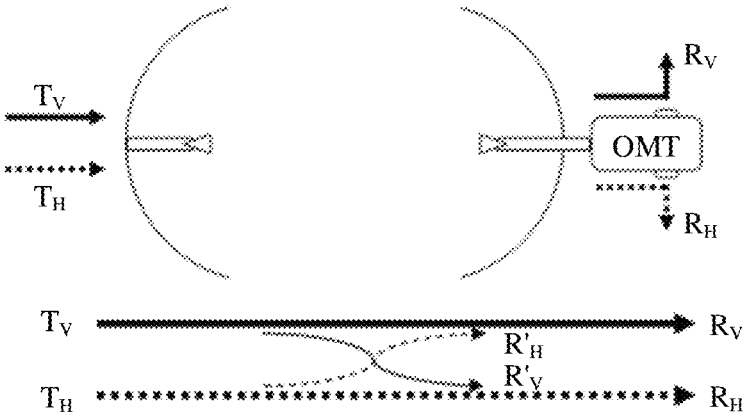
FIG. 2*c* is a schematic diagram of possible XPD performance according to an embodiment of this application.

The dual polarization antenna may transmit linear polarization signals in both a horizontal direction and a vertical direction. However, in actual application, a cross coupling problem exists between two intra-frequency orthogonal polarization channels. Therefore, XPD is an important indicator of dual polarization transmission. FIG. 2*c* is a schematic diagram of possible XPD performance according to an embodiment of this application. The XPD in this embodiment of this application may refer to a ratio, that corresponds when a transmit antenna transmits a vertical polarization wave $R_V$, of a signal level $R_V$ received by a receive antenna on co-polarization (namely, a vertical polarization channel) to a signal level received by the receive antenna on cross polarization (namely, a horizontal polarization channel). Alternatively, the XPD may refer to a ratio, that corresponds when a transmit antenna transmits a horizontal polarization wave $T_H$, of a signal level $R_H$ received by a receive antenna on co-polarization (namely, a horizontal polarization channel) to a signal level $R'_H$ received by the receive antenna on cross polarization (namely, a vertical polarization channel).

Therefore, XPD performance deterioration causes mutual interference between two transmitted polarization signals, and this seriously affects transmission quality.

In actual application, since there is no XPD performance indicator requirement on the single polarization antenna, the XPD performance is not commissioned during production. Consequently, the XPD performance of the dual polarization antenna cannot meet a requirement after the single polarization antenna is upgraded and reconstructed to the dual polarization antenna.

In view of this, this application provides an OMT assembly. The OMT assembly is configured to adjust the XPD performance of the dual polarization antenna after upgrade and reconstruction, to improve operability of upgrading the single polarization antenna to the dual polarization antenna.

To facilitate understanding of the embodiments of this application, an implementation principle of the embodiments of this application is briefly described first.

It is assumed that $X_1$ and $X_2$ are two transmit signals for which a same frequency is reused, and $Y_1$ and $Y_2$ are signals obtained by transmitting $X_1$ and $X_2$ through a cross polarization device (for example, a small-ellipticity circular waveguide). In this case, a cross polarization effect may be simulated as:

$$\begin{bmatrix} Y_1 \\ Y_2 \end{bmatrix} = \begin{bmatrix} A & c \\ d & B \end{bmatrix} \begin{bmatrix} X_1 \\ X_2 \end{bmatrix}, \quad \text{Formula (1)}$$

where diagonal elements A and B are signals that are needed, and non-diagonal elements c and d represent cross polarization, or $$\overline{Y} = T\overline{X} \quad \text{Formula (2).}$$

It may be understood that, in a linear algebraic language, Formula (2) means that a linear operator T is defined in signal space for the cross polarization effect, and the linear operator T defines a special relationship between signal space vectors. If a fixed substrate is used as a reference, the special relationship may be described by using a matrix. If the cross polarization operator T transforms $\overline{X}$ to $\overline{Y}$, when a linear substrate $\{e_1, e_2\}$ is used as a reference, a relationship between $[\overline{X}]_e$ and $[\overline{Y}]_e$ may be described by using $[T]_e$. Therefore, the following is obtained:

$$[\overline{Y}]_e = [T]_e [\overline{X}]_e \quad \text{Formula (3)}$$

Figure 3:
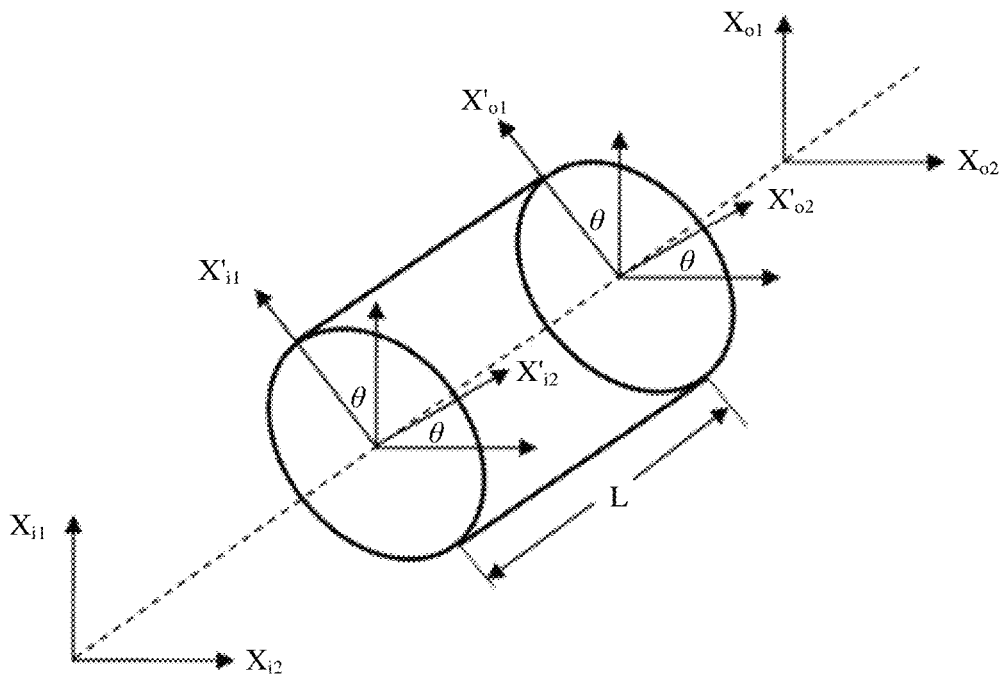
FIG. 3 is a schematic diagram of a possible cross polarization vector of a small-ellipticity circular waveguide according to an embodiment of this application.

In view of the cross polarization effect generated by the small-ellipticity circular waveguide, refer to FIG. 3. FIG. 3 is a schematic diagram of a possible cross polarization vector of a small-ellipticity circular waveguide according to an embodiment of this application. $X_{i1}$ and $X_{i2}$ represent a pair of orthogonal polarization vectors of the signal space, $X_{i1}'$ and $X_{i2}'$ respectively represent a polarization vector inputted along a shorter axis of the small-ellipticity circular waveguide and a polarization vector inputted along a longer axis of the small-ellipticity circular waveguide, $X_{o2}'$ and $X_{o1}'$ respectively represent a polarization vector outputted along a shorter axis of the small-ellipticity circular waveguide and a polarization vector outputted along a longer axis of the small-ellipticity circular waveguide, and $X_{o1}$ and $X_{o2}$ respectively represent an output orthogonal polarization vector corresponding to $X_{i1}$ and an output orthogonal polarization vector corresponding to $X_{i2}$, where θ is a tilt angle of the small-ellipticity circular waveguide. Therefore, the following formula may be obtained:

$$\begin{bmatrix} X_{i1} \\ X_{i2} \end{bmatrix} = \begin{bmatrix} \cos\theta & -\sin\theta \\ \sin\theta & \cos\theta \end{bmatrix} \begin{bmatrix} X_{i1}' \\ X_{i2}' \end{bmatrix} \quad \text{Formula (4)}$$

$$\begin{bmatrix} X_{i1}' \\ X_{i2}' \end{bmatrix} = \begin{bmatrix} T_1 & 0 \\ 0 & T_2 \end{bmatrix} \begin{bmatrix} X_{o1}' \\ X_{o2}' \end{bmatrix}$$

$$\begin{bmatrix} X_{o1}' \\ X_{o2}' \end{bmatrix} = \begin{bmatrix} \cos\theta & \sin\theta \\ -\sin\theta & \cos\theta \end{bmatrix} \begin{bmatrix} X_{o1} \\ X_{o2} \end{bmatrix}$$

$$T_1 = e^{-(\alpha_1 + j\beta_1)L}$$

In Formula (4), $T_2 = e^{-(\alpha_2 + j\beta_1)L}$, where $\alpha_1$ and $\alpha_2$ are attenuation constants of polarized signals along the longer axis and the shorter axis of the small-ellipticity circular waveguide, $\beta_1$ and $\beta_2$ are phase shift constants of polarization signals along the longer axis and the shorter axis of the small-ellipticity circular waveguide, and L is a length of the small-ellipticity circular waveguide.

With reference to Formula (4), Formula (5) may be obtained:

$$\begin{bmatrix} X_{i1} \\ X_{i2} \end{bmatrix} = \begin{bmatrix} \cos\theta & -\sin\theta \\ \sin\theta & \cos\theta \end{bmatrix} \begin{bmatrix} T_1 & 0 \\ 0 & T_2 \end{bmatrix} \begin{bmatrix} \cos\theta & \sin\theta \\ -\sin\theta & \cos\theta \end{bmatrix} \begin{bmatrix} X_{o1} \\ X_{o2} \end{bmatrix} \quad \text{Formula (5)}$$

Therefore, with reference to Formula (3) and Formula (5), it can be learned that a matrix, under the linear substrate, of the cross polarization operator T of the small-ellipticity circular waveguide is represented as:

$$[T]_e = \begin{bmatrix} \cos\theta & -\sin\theta \\ \sin\theta & \cos\theta \end{bmatrix} \begin{bmatrix} T_1 & 0 \\ 0 & T_2 \end{bmatrix} \begin{bmatrix} \cos\theta & \sin\theta \\ -\sin\theta & \cos\theta \end{bmatrix} = \begin{bmatrix} A & C \\ C & B \end{bmatrix} \quad \text{Formula (6)}$$

It needs to be noted that, if any substrate $\{m_i\}$ can be found, and the cross polarization operator T enables a vector V to meet:

$[T]_m[V]_m = \lambda[V]_m$, V is an eigenvector, and λ is an eigenvalue corresponding to the cross polarization operator T.

The eigenvector is used to perform diagonalization processing on the matrix $[T]_e$ in Formula (6), and therefore two eigenvalues $\lambda_1$ and $\lambda_2$ may be represented as $$\begin{cases} \lambda_1 = A - \tau \\ \lambda_2 = B + \tau \end{cases},$$

where $\tau = \frac{1}{2}\{\sqrt{(B-A)^2 + 4C^2} - (B-A)\}$. The eigenvectors corresponding to the two eigenvalues $\lambda_1$ and $\lambda_2$ are:

$$V_1 = \begin{pmatrix} \cos\theta_0 \\ -\sin\theta_0 \end{pmatrix} \quad \text{Formula (7)}$$

$$V_2 = \begin{pmatrix} \sin\theta_0 \\ \cos\theta_0 \end{pmatrix}$$

$$\theta_0 = -\theta$$

That is, if $\{V_1, V_2\}$ in Formula (7) is used as a substrate, $$[T]_V = \begin{bmatrix} \lambda_1 & 0 \\ 0 & \lambda_2 \end{bmatrix} \quad \text{Formula (8)}$$

Figure 4:
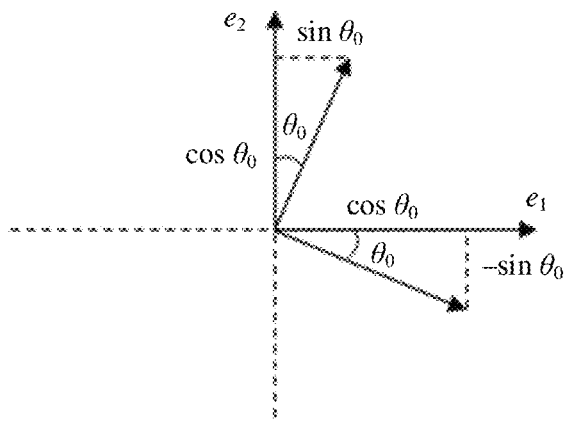
FIG. 4 is a schematic diagram of a possible substrate according to an embodiment of this application.

The substrate $\{V_1, V_2\}$ is a pair of orthogonal linear polarizations, and rotates an angle relative to the linear substrate $\{e_1, e_2\}$. Under such a substrate, as shown in FIG. 4, the cross polarization effect disappears.

Therefore, it may be concluded from Formula (7) and Formula (8) that the cross polarization effect of the small-ellipticity circular waveguide may be eliminated by rotating the small-ellipticity circular waveguide. In actual application, although it is not known how many degrees or in which direction the small-ellipticity circular waveguide needs to be rotated, the small-ellipticity circular waveguide can always be rotated to a position, thereby eliminating the cross polarization effect introduced by the small-ellipticity circular waveguide.

Figure 5A:
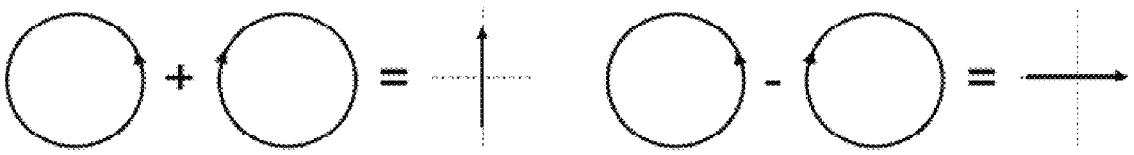
FIG. 5*a* is a schematic diagram of a possible linear polarization signal combined with a circular polarization signal according to an embodiment of this application.
Figure 5B:
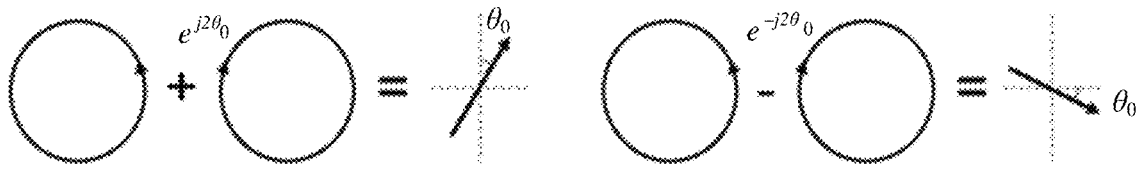
FIG. 5*b* is another schematic diagram of a possible linear polarization signal combined with a circular polarization signal according to an embodiment of this application.

Two equal-amplitude reversed circular polarizations may be combined into a linear polarization signal, as shown in FIG. 5*a*, linear polarizations in different polarization directions can be obtained by adjusting relative phases between the two circular polarizations, as shown in FIG. 5*b*. Therefore, a relationship between the two orthogonal circular polarizations is adjusted, so that the transmitted signal is carried by the eigenvector, and the cross polarization effect caused by the small-ellipticity circular waveguide can be eliminated.

Figure 6:
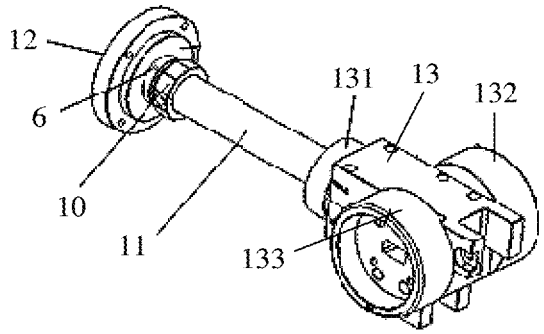
FIG. 6 is a schematic diagram of a possible OMT assembly according to an embodiment of this application.

Based on the foregoing conclusion, this application provides an OMT assembly. FIG. 6 is a schematic diagram of a possible OMT assembly according to an embodiment of this application. The OMT assembly 600 includes an OMT common port 12, an OMT feeder 11, and a polarization separated core 13. An input end of the OMT common port 12 is connected to a to-be-reconstructed single polarization antenna, one end of the OMT feeder 11 is connected to an output end of the OMT common port 12, and the other end of the OMT feeder 11 is connected to the polarization separated core 13, so that the OMT feeder 11 located between the OMT common port 12 and the polarization separated core 13 rotates. The OMT feeder 11 is of a tubular structure, and a horizontal axis and a vertical axis of an inner wall cross section of the OMT feeder 11 are unequal, or a tuning rod is disposed in a tube of the OMT feeder 11, and the tuning rod is perpendicular to an extension direction of the tube of the OMT feeder 11. A vertical polarization port 132 and a horizontal polarization port 133 are disposed in the polarization separated core 13, the vertical polarization port 132 is configured to transmit a vertical polarization signal, and the horizontal polarization port 133 is configured to transmit a horizontal polarization signal. Therefore, by rotating the OMT feeder 11, a relative phase between two circular polarization signals output by the to-be-reconstructed single polarization antenna may be adjusted to obtain linear polarization signals in different polarization directions, to adjust a polarization rotation component caused by an elliptic feeder of the to-be-reconstructed single polarization antenna to a horizontal linear polarization and a vertical linear polarization. In this way, a horizontal signal and a vertical signal are separated, and the XPD performance of a reconstructed dual polarization antenna is adjusted.

Optionally, the horizontal axis and the vertical axis of the inner wall cross section of the OMT feeder 11 are unequal. The horizontal axis and the vertical axis in this embodiment of this application may be understood as that when the OMT feeder 11 does not affect an XPD value of the antenna, that is, does not perform an adjustment function, the horizontal axis of the OMT feeder 11 is consistent with a transmission direction of the horizontal polarization signal, and the vertical axis of the OMT feeder 11 is consistent with a transmission direction of the vertical polarization signal. For example, the inner wall cross section of the OMT feeder 11 may be an ellipse, and an ellipticity value of the ellipse (where a smaller ellipticity indicates a closer proximity to a standard circle) is related to the XPD value of the single polarization antenna. It needs to be noted that, when an error between an XPD value of the OMT feeder and the XPD value of the single polarization antenna is within a preset range, to be specific, when the XPD value of the OMT feeder is equivalent to the XPD value of the single polarization antenna, it may be considered that a cross polarization effect caused by a small elliptic feeder of the single polarization antenna can be eliminated by rotating the OMT feeder. Therefore, when a smaller XPD value of the single polarization antenna indicates a larger cross polarization effect, the XPD value of the OMT feeder 11 is also smaller, and the ellipticity of the inner wall cross section corresponding to the OMT feeder 11 is larger. When the XPD value of the single polarization antenna is larger, the XPD value of the OMT feeder 11 is also larger, and the ellipticity of the inner wall cross section corresponding to the OMT feeder 11 is smaller. Therefore, when the inner wall cross section of the OMT feeder 11 is the ellipse, the ellipticity value of the ellipse is negatively correlated with the XPD value of the single polarization antenna. To be specific, if the XPD value of the single polarization antenna is larger, the ellipticity value of the ellipse is smaller, or if the XPD value of the single polarization antenna is smaller, the ellipticity value of the ellipse is larger.

Figure 7:
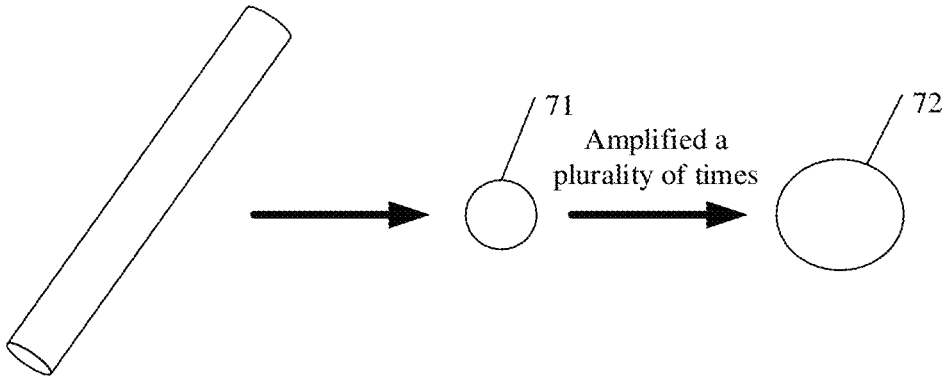
FIG. 7 is a schematic diagram of a possible OMT feeder according to an embodiment of this application.

It needs to be noted that, when the inner wall cross section of the OMT feeder 11 is the ellipse, in actual application, the ellipse may not be observed by naked eyes. For example, FIG. 7 is a possible schematic diagram of an OMT feeder according to an embodiment of this application. In a normal case, a front view 71 of the inner wall cross section of the OMT feeder 11 is a standard circle. When the inner wall cross section is amplified a plurality of times, it may be observed that the front view 72 of the inner wall cross section of the OMT feeder 11 is the ellipse.

Optionally, when the inner wall cross section of the OMT feeder 11 is the ellipse, a length ratio of a shorter axis of the ellipse to a longer axis of the ellipse may range from 0.85 to 0.99.

Optionally, when the inner wall cross section of the OMT feeder 11 is the ellipse, an outer wall cross section of the OMT feeder 11 may be a circle, a square, or another polygon. This is not specifically limited herein.

Optionally, the inner wall cross section of the OMT feeder 11 may alternatively be a rectangle. It is similar to a case in which the inner wall cross section is the ellipse, a value of proximity of the rectangle (where a larger proximity indicates that the rectangle is closer to a square) is related to the XPD value of the single polarization antenna. In addition, the value of the proximity of the rectangle is positively correlated with the XPD value of the single polarization antenna. To be specific, if the XPD value of the single polarization antenna is larger, the proximity of the rectangle is larger, or if the XPD value of the single polarization antenna is smaller, the proximity of the rectangle is smaller. When the inner wall cross section of the OMT feeder 11 is the rectangle, the outer wall cross section of the OMT feeder 11 may be a circle, a square, or another polygon. This is not specifically limited herein.

Figure 8:
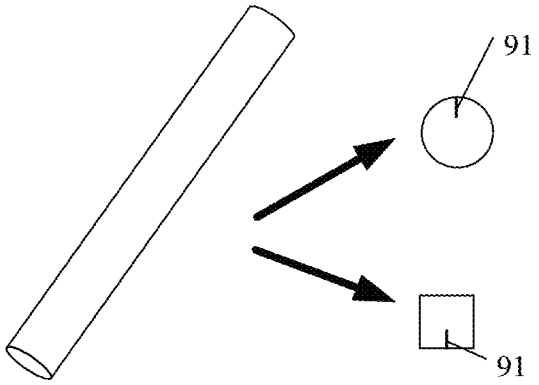
FIG. 8 is a schematic diagram of another possible OMT feeder according to an embodiment of this application.

In addition, the tuning rod may also be disposed in the tube of the OMT feeder 11. Optionally, a direction in which the tuning rod points intersects a center line of the tube of the OMT feeder 11. It needs to be noted that when the tuning rod is disposed in the tube of the OMT feeder, the inner wall cross section of the OMT feeder may be a regular polygon, for example, a square, a regular hexagon, or a circle. This is not specifically limited herein. For ease of understanding, refer to FIG. 8. FIG. 8 is a schematic diagram of another possible OMT feeder according to an embodiment of this application. When the inner wall cross section of the OMT feeder 11 is a circle or a square, and a tuning rod 91 is disposed in the tube, FIG. 8 shows a possible front view of the inner wall cross section of the OMT feeder 11. The tuning rod 91 is perpendicular to an extension direction of the tube of the OMT feeder 11, and the tuning rod 91 or an extension line of the tuning rod 91 intersects the center line of the tube of the OMT feeder 11. It needs to be noted that a quantity of tuning rods 91 disposed in the tube of the OMT feeder 11 may be related to a frequency of a signal transmitted in the OMT feeder. For example, a lower frequency of a transmitted signal may indicate a larger quantity of disposed tuning rods 91. Therefore, there may be one or more tuning rods 91. In addition, it needs to be noted that when there are a plurality of tuning rods 91, lengths of the tuning rods 91 may be completely consistent or not completely consistent. This is not specifically limited herein.

Optionally, when the tuning rod may also be disposed in the tube of the OMT feeder 11, one or two tuning rods 91 may be disposed on any inner wall cross section on which the tuning rod 91 is disposed and that is in the tube of the OMT feeder 11. When one tuning rod 91 is disposed, a length of the tuning rod accounts for 15% to 35% of the horizontal axis or the vertical axis of the inner wall cross section. When two tuning rods are disposed, lengths of the two tuning rods 91 may be equal, and each of the lengths accounts for 7% to 18% of the horizontal axis or the vertical axis of the inner wall cross section of the OMT feeder 11. For example, when a cross section of the OMT feeder 11 is a circle, two tuning rods may be disposed opposite to each other in the OMT feeder, and lengths of the two tuning rods each account for 17% of a diameter of the circle. A specific quantity of tuning rods is not limited in this application.

Optionally, one end of the OMT feeder 11 is nestedly connected to an output end of the OMT common port 12, and the other end of the OMT feeder is nestedly connected to the polarization separated core 13, so that the OMT feeder 11 can be rotated. It needs to be noted that, in this embodiment of this application, in addition to being nestedly connected, the OMT feeder 11 may be connected to the OMT common port 12 and the polarization separated core 13 through a buckle. This is not specifically limited herein.

Optionally, the OMT feeder 11 is of a detachable structure. For example, when the OMT feeder 11 is connected to the output end of the OMT common port 12 and the polarization separated core 13 through the buckle, disassembling the buckle can separate the OMT feeder 11 from the connected OMT common port 12 and polarization separated core 13, so that the OMT feeder 11 is detachable. In this way, in actual application, the OMT feeder 11 is detachably removed and replaced, thereby improving flexibility of adjusting XPD performance.

Figure 9:
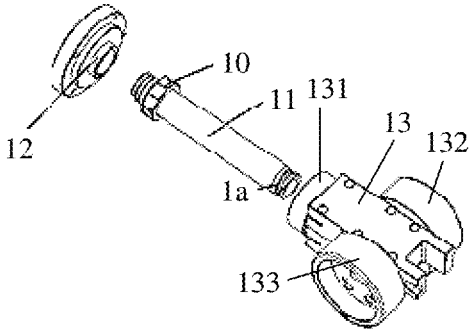
FIG. 9 is a structural explosive diagram of a possible OMT assembly according to an embodiment of this application.

It needs to be noted that, to implement a rotation operation on the OMT feeder 11, the OMT assembly further includes a rotation component, and the rotation component is connected to an outer wall of the OMT feeder 11. It needs to be noted that the rotation component is fixedly connected to the outer wall of the OMT feeder 11. The fixed connection may include a connection through welding, a connection through a screw, or the like. The rotation component is configured to perform the rotation operation on the OMT feeder 11 when XPD performance of the dual polarization antenna is adjusted. For ease of understanding, refer to FIG. 9. FIG. 9 is a structural explosive diagram of a possible OMT assembly according to an embodiment of this application. A rotation component 10 may be designed on the OMT feeder 11. Specifically, the rotation component 10 may be a nut, for example, a hexagon nut or a quadrangle nut, so that the rotation operation is performed on the rotation component 10 by using an auxiliary tool such as a wrench to drive rotation of the OMT feeder. In this way, the XPD performance of the reconstructed dual polarization antenna is adjusted.

Optionally, in this embodiment of this application, the rotation operation on the OMT feeder 11 may also be implemented by using a plane area included on a surface of the OMT feeder 11. For example, a non-smooth surface with a relatively large friction force is disposed on the surface of the OMT feeder 11, and the non-smooth surface is the plane area, so that the auxiliary tool acts on the non-smooth surface to drive rotation of OMT feeder 11. Alternatively, a first plane and a second plane are disposed on the surface of the OMT feeder 11, and the first plane and the second plane may be two planes symmetrical to the center line of the tube. In this way, the first plane and the second plane are plane areas, so that the OMT feeder 11 can be clamped through the first plane and the second plane by using the auxiliary tool, to perform an operation of rotating the OMT feeder 11. Therefore, in this embodiment of this application, the plane area included on the surface of the OMT feeder is not specifically limited.

Optionally, the OMT assembly further includes a lock-up component, a through hole 6 is provided on a side wall of the output end of the OMT common port, and the lock-up component passes through the through hole 6 and presses against the OMT feeder 11 in the output end of the OMT common port, and the lock-up component is configured to keep the OMT feeder still after performing rotation adjustment on the OMT feeder. Specifically, the lock-up component may be a set screw or a machine screw. For example, the set screw may be a hexagon socket screw, and then the lock-up component is fastened by using the auxiliary tool such as a screwdriver, so that the adjusted OMT feeder 11 keeps still.

Figure 10:
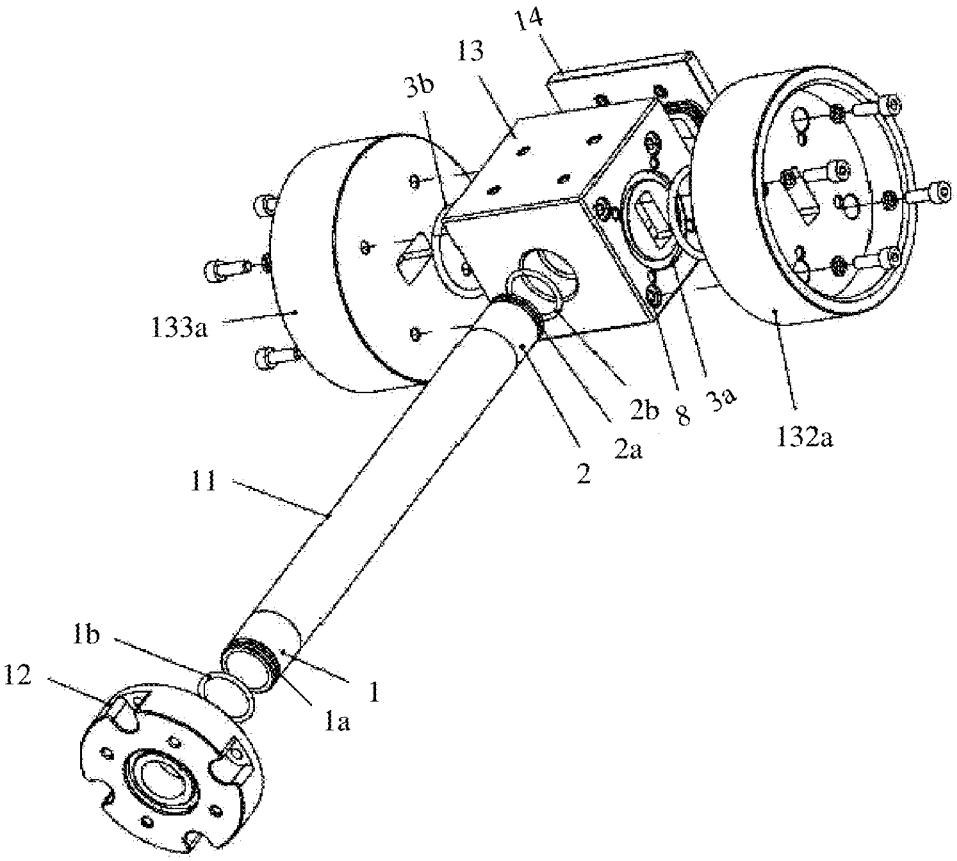
FIG. 10 is a structural explosive diagram of another possible OMT assembly according to an embodiment of this application.

Optionally, FIG. 10 is a structural explosive diagram of another possible OMT assembly according to an embodiment of this application. A first ring sealing groove 1*a* is disposed on a surface of one end 1 that is of the OMT feeder 11 and that is connected to the OMT common port 12, a first sealing ring 1*b* is disposed in the first sealing groove, and a gap between the OMT feeder 11 and the OMT common port 12 is sealed through the first sealing ring 1*b*, to implement waterproofing and adapt to a structural dimension tolerance in a radial direction. Correspondingly, a second sealing groove 2*a* is disposed on a surface of one end 2 that is of the OMT feeder 11 and that is connected to the polarization separated core 13, a second sealing ring 2*b* is disposed in the second sealing groove 2*a*, and a gap between the polarization separated core 13 and the OMT feeder 11 is sealed through the second sealing ring 2*b*.

Optionally, a material of the OMT feeder 11 is a metal material, for example, aluminum. Advantages of using the metal aluminum to make the OMT feeder include: 1. light weight, 2. easy to shape, 3. high cost-effectiveness, and the like. In actual application, another metal may alternatively be used. This is not specifically limited in this application.

In addition, referring to the structural explosive diagram of the OMT assembly shown in FIG. 9, a front port 131 configured to connect to the OMT feeder 11 may be disposed in the polarization separated core 13, and a vertical polarization port 132 and a horizontal polarization port 133 are disposed in the polarization separated core 13. Optionally, the vertical polarization port 132 and the horizontal polarization port 133 may be separately disposed on two opposite sides of the polarization separated core 13. It needs to be noted that the vertical polarization port 132 and the horizontal polarization port 133 may be coaxial and perpendicular to each other, or parallel to each other. This is not specifically limited herein. The vertical polarization port 132 and the horizontal polarization port 133 perform synthetic transmission in a single mode. In a transmission process, a vertical polarization and a horizontal polarization do not interfere with each other, and this process is reversible. It needs to be noted that the front port 131 may be connected to the vertical polarization port 132 and the horizontal polarization port 133 through a one-to-two waveguide tube.

Optionally, based on the polarization component core 13 shown in FIG. 9, the vertical polarization port 132 and the horizontal polarization port 133 may be symmetrically connected to a vertical exit transition section 132*a* and a horizontal exit transition section 133*a* respectively. Specifically, the vertical polarization port 132 is connected to the vertical exit transition section 132*a*, the horizontal polarization port 133 is connected to the horizontal exit transition section 133*a*, and the vertical exit transition section 132*a* and the horizontal exit transition section 133*a* may be symmetrically disposed.

Optionally, a plurality of connection holes 8 are evenly distributed on the outer wall of the polarization separated core 13 around the vertical polarization port 132 and the horizontal polarization port 133, the vertical exit transition section 132*a* and the horizontal exit transition section 133*a* are separately fastened to the polarization separated core 13 by inserting a bolt into the connection hole 8, to implement connection to the vertical polarization port 132 and the horizontal polarization port 133.

Optionally, a third ring sealing groove 3*a* is disposed on the outer wall of the polarization separated core 13, a third sealing ring 3*b* is placed in the third ring sealing groove 3*a*, and a gap between the polarization separated core 13 and the vertical exit transition section 132*a* is sealed through the third sealing ring 3*b*. Correspondingly, a fourth ring sealing groove is disposed on the outer wall of the polarization separated core 13, a fourth sealing ring is placed in the fourth ring sealing groove, and a gap between the polarization separated core 13 and the horizontal exit transition section 10 is sealed through the fourth sealing ring.

Optionally, the output end of the polarization separated core 13 may be alternatively sealed by a cover 14, to facilitate assembly of internal components.

In this embodiment of this application, the tube of the OMT feeder of the OMT assembly may be designed in an elliptic shape, and a relative phase between two circular polarization signals is adjusted to obtain two linear polarization signals in a vertical polarization direction and a horizontal polarization direction. In this way, a cross polarization effect caused by an elliptic feeder tube of the single polarization antenna is eliminated, and the XPD performance of the dual polarization antenna after upgrade and reconstruction is adjusted. By using the OMT assembly provided in this embodiment of this application, the XPD performance of the upgraded dual polarization antenna can be adjusted without adjusting the feeder of the single polarization antenna, thereby resolving a problem that the XPD performance of the reconstructed dual polarization antenna deteriorates because the feeder of the single polarization antenna is not commissioned for there is no XPD indicator for the single polarization antenna.

Figure 1:
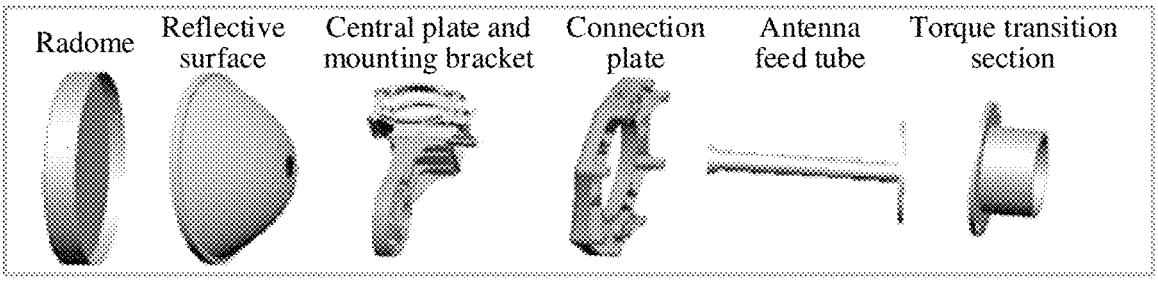
FIG. 1 is a schematic diagram of possible components of a single polarization antenna.
Figure 11:
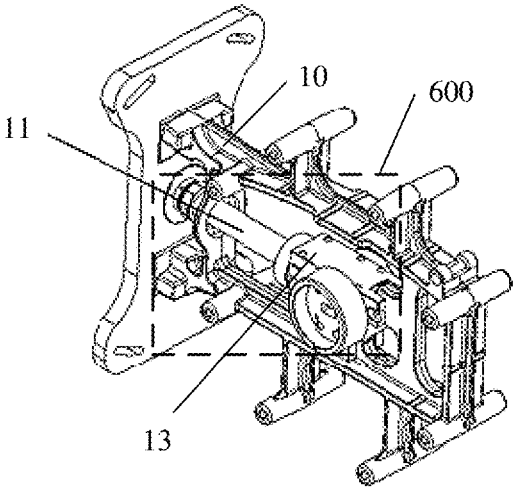
FIG. 11 is a schematic diagram of a possible OMT apparatus according to an embodiment of this application.

FIG. 11 is a schematic diagram of a possible OMT apparatus based on any OMT assembly described in FIG. 6, FIG. 7, or FIG. 1 according to an embodiment of this application. The OMT apparatus 1100 includes a framework 10 and an OMT assembly 600 installed and fastened on the framework 10.

The OMT apparatus 1100 is configured to upgrade and reconstruct a single polarization antenna to a dual polarization antenna. It needs to be noted that, when the OMT apparatus 1100 is delivered from a factory, a direction of a longer axis and a direction of a shorter axis of the OMT feeder 11 in the OMT assembly may be respectively in a vertical state and a horizontal state. When the to-be-reconstructed single polarization antenna is connected to the OMT apparatus 1100, to be upgraded to the dual polarization antenna, if the initial XPD performance of the dual polarization antenna can meet a use requirement, it may be understood that the XPD value of the dual polarization antenna after the reconstruction is greater than a preset threshold. In this case, the OMT feeder 11 does not need to be rotated to adjust the XPD performance of the reconstructed dual polarization antenna, and the OMT feeder 11 does not cause XPD performance deterioration of the reconstructed dual polarization antenna. If the initial XPD performance of the reconstructed dual polarization antenna cannot meet the use requirement, it may be understood that when the XPD value of the reconstructed dual polarization antenna is less than the preset threshold, the OMT feeder 11 of an additionally connected OMT apparatus is rotated to adjust a relative phase between two circular polarization signals propagated by the single polarization antenna, and adjust a polarization rotation component caused by an elliptic feeder of the single polarization antenna to a horizontal polarization component and a vertical polarization component, so that a cross polarization effect is reduced. The XPD performance of the reconstructed dual polarization antenna is ensured without replacing or rotating the feeder tube of the single polarization antenna, and this greatly improves operability of upgrade and reconstruction.

Optionally, when the XPD performance of the reconstructed dual polarization antenna is adjusted, the horizontal polarization port and the vertical polarization port of the OMT assembly 600 in the OMT apparatus 1100 are separately connected to a first detection device, to detect an output power of the horizontal polarization port and an output power of the vertical polarization port when the OMT feeder 11 is rotated. If a difference between the output power of the horizontal polarization port and the output power of the vertical polarization port is the largest in a process of rotating the OMT feeder 11, when the difference is the maximum difference, the XPD performance of the dual polarization antenna is adjusted, and the OMT feeder 11 may be further locked. Alternatively, in this embodiment of this application, when the OMT feeder 11 is rotated, the XPD value of the dual polarization antenna may be read in real time through a second detection device connected to the OMT apparatus. When the XPD value of the dual polarization antenna is the largest in the rotation process, the XPD performance of the reconstructed dual polarization antenna is adjusted.

Optionally, when the XPD performance of the reconstructed dual polarization antenna is adjusted, the horizontal polarization port 133 and the vertical polarization port 132 of the OMT assembly 600 in the OMT apparatus 1100 are separately connected to a third detection device, and the OMT common port 12 is short-circuited, to detect isolation between the horizontal polarization port 133 and the vertical polarization port 132. The isolation in this application may be understood as a ratio of a transmit power of a horizontal polarization channel to a transmit power leaked to a vertical polarization channel, or the isolation in this application may be understood as a ratio of a transmit power leaked to a vertical polarization channel to a transmit power of a horizontal polarization channel. For example, when it is detected that the isolation between the horizontal polarization port and the vertical polarization port is within a preset range, for example, −8 dB to −40 dB, the XPD performance of the reconstructed dual polarization antenna is adjusted.

Optionally, after the XPD performance of the dual polarization antenna is adjusted by rotating the OMT feeder 11, the adjusted OMT feeder 11 may be kept still through the lock-up component shown in FIG. 6 or FIG. 9.

In the foregoing implementations, when the XPD value of the reconstructed dual polarization antenna is adjusted on site by rotating the OMT feeder 11 in the OMT apparatus 1100, a corresponding detection device may be connected for implementation and monitoring. Compared with a prior-art manner in which only blind adjustment can be performed, onsite implementation efficiency is improved.

The OMT assembly provided in this embodiment of this application and the OMT apparatus including the OMT assembly have the following beneficial effects:

1. After the reconstruction, the XPD performance of the dual polarization antenna is improved by rotating and adjusting the OMT feeder on the additionally connected OMT apparatus. In this way, the XPD performance of the dual polarization antenna is improved without replacing or rotating the feeder of the single polarization antenna, and the operability of reconstructing the single polarization antenna to the dual polarization antenna is improved.

2. When the XPD performance of the reconstructed dual polarization antenna meets the use requirement, the OMT feeder in the OMT apparatus does not cause XPD performance deterioration of the dual polarization antenna.

3. When the XPD value of the reconstructed dual polarization antenna is adjusted by rotating the OMT feeder in the OMT apparatus on site, the corresponding detection device may be connected for monitoring, thereby improving onsite implementation efficiency.

4. The gap between the OMT feeder and the polarization separated core and the gap between the OMT feeder and the OMT common port can be sealed through the sealing ring, to implement waterproofing and adapt to a structural dimension tolerance in a radial direction, thereby improving sealing performance and structural precision, and further improving electrical performance.

The foregoing descriptions are merely specific implementations of this application, but are not intended to limit the protection scope of this application. Any variation or replacement readily figured out by a person skilled in the art within the technical scope disclosed in this application shall fall within the protection scope of this application. Therefore, the protection scope of this application shall be subject to the protection scope of the claims.

What is claimed is:

1. An ortho-mode transducer (OMT) assembly, comprising:

an OMT common port;

an OMT feeder; and a polarization separated core, wherein an input end of the OMT common port is connected to a single polarization antenna, wherein a first end of the OMT feeder is connected to an output end of the OMT common port, and a second end of the OMT feeder is connected to the polarization separated core, so that the OMT feeder located between the OMT common port and the polarization separated core rotates, wherein the OMT feeder is of a tubular structure, and a horizontal axis and a vertical axis of an inner wall cross section of the OMT feeder are unequal, or a tuning rod is disposed in a tube of the OMT feeder, and the tuning rod is perpendicular to an extension direction of the tube of the OMT feeder, and wherein a vertical polarization port and a horizontal polarization port are disposed in the polarization separated core, the vertical polarization port is configured to transmit a vertical polarization wave, and the horizontal polarization port is configured to transmit a horizontal polarization wave.

2. The OMT assembly according to claim 1, wherein, when the horizontal axis and the vertical axis of the inner wall cross section of the OMT feeder are unequal, the inner wall cross section of the OMT feeder is an ellipse.

3. The OMT assembly according to claim 2, wherein an outer wall cross section of the OMT feeder is a circle.

4. The OMT assembly according to claim 2, wherein an ellipticity of the ellipse is negatively correlated with a cross polarization discrimination (XPD) value of the single polarization antenna.

5. The OMT assembly according to claim 1, wherein, when the horizontal axis and the vertical axis of the inner wall cross section of the OMT feeder are unequal, the inner wall cross section of the OMT feeder is a rectangle.

6. The OMT assembly according to claim 1, wherein, when the horizontal axis and the vertical axis of the inner wall cross section of the OMT feeder are unequal, a length ratio of a shorter axis to a longer axis of the horizontal axis and the vertical axis ranges from 0.85 to 0.99.

7. The OMT assembly according to claim 1, wherein, when the tuning rod is disposed in the tube of the OMT feeder, a direction in which the tuning rod points intersects a center line of the tube of the OMT feeder.

8. The OMT assembly according to claim 1, wherein, when the tuning rod is disposed in the tube of the OMT feeder, the inner wall cross section of the OMT feeder is a regular polygon.

9. The OMT assembly according to claim 8, wherein, when one tuning rod is disposed in the tube of the OMT feeder, a length of the tuning rod accounts for 15% to 35% of the horizontal axis or the vertical axis of the inner wall cross section of the OMT feeder.

10. The OMT assembly according to claim 8, wherein, when two tuning rods of an equal length are disposed in the tube of the OMT feeder, a length of each tuning rod of the two tuning rods accounts for 7% to 18% of the horizontal axis or the vertical axis of the inner wall cross section of the OMT feeder.

11. The OMT assembly according to claim 1, wherein the first end of the OMT feeder is nestedly connected to the output end of the OMT common port, and the second end of the OMT feeder is nestedly connected to the polarization separated core.

12. The OMT assembly according to claim 11, wherein the OMT assembly further comprises a rotation component, and the rotation component is connected to an outer wall of the OMT feeder.

13. The OMT assembly according to claim 12, wherein the rotation component comprises an outer hexagon nut.

14. The OMT assembly according to claim 13, wherein the OMT assembly further comprises a lock-up component, a through hole is provided on a side wall of the output end of the OMT common port, the lock-up component passes through the through hole and presses against the OMT feeder in the output end of the OMT common port, and the lock-up component is configured to keep the OMT feeder still after performing rotation adjustment on the OMT feeder.

15. The OMT assembly according to claim 14, wherein the lock-up component comprises a screw.

16. The OMT assembly according to claim 1, wherein the OMT assembly further comprises a first sealing ring, the first sealing ring is placed in a first sealing groove, the first sealing groove is disposed on a surface of the first end of the OMT feeder, and the first sealing ring is configured to seal a gap between the OMT feeder and the OMT common port.

17. The OMT assembly according to claim 1, wherein the OMT assembly further comprises a second sealing ring, the second sealing ring is placed in a second sealing groove, the second sealing groove is disposed on a surface of the second end of the OMT feeder, and the second sealing ring is configured to seal a gap between the OMT feeder and the polarization separated core.

18. The OMT assembly according to claim 1, wherein a material of the OMT feeder comprises a metal material.

19. The OMT assembly according to claim 1, wherein a first cross section size of the OMT feeder is smaller than a second cross section size of the OMT common port, wherein the OMT feeder is rotatable relative to the OMT common port and the polarization separated core, wherein the OMT feeder is detachable from the OMT common port and the polarization separated core, and wherein the vertical polarization port and the horizontal polarization port are separately disposed on two opposite sides of the polarization separated core.

20. An ortho-mode transducer (OMT) apparatus, comprising:

a framework; and an OMT assembly, wherein the OMT assembly comprises:

an OMT common port;

an OMT feeder; and a polarization separated core, wherein an input end of the OMT common port is connected to a single polarization antenna, wherein a first end of the OMT feeder is connected to an output end of the OMT common port, and a second end of the OMT feeder is connected to the polarization separated core, so that the OMT feeder located between the OMT common port and the polarization separated core rotates, wherein the OMT feeder is of a tubular structure, and a horizontal axis and a vertical axis of an inner wall cross section of the OMT feeder are unequal, or a tuning rod is disposed in a tube of the OMT feeder, and the tuning rod is perpendicular to an extension direction of the tube of the OMT feeder, wherein a vertical polarization port and a horizontal polarization port are disposed in the polarization separated core, the vertical polarization port is configured to transmit a vertical polarization wave, and the horizontal polarization port is configured to transmit a horizontal polarization wave; and wherein the framework is configured to install and fasten the OMT assembly.

21. The OMT apparatus according to claim 20, wherein, when the horizontal axis and the vertical axis of the inner wall cross section of the OMT feeder are unequal, the inner wall cross section of the OMT feeder is an ellipse.

* * * * *